US005126929A

United States Patent [19]

Cheselske

[11] Patent Number: 5,126,929

[45] Date of Patent: Jun. 30, 1992

[54] LED HOLDER WITH LENS

[75] Inventor: David A. Cheselske, Upland, Calif.

[73] Assignee: R & D Molded Products, Inc., San Dimas, Calif.

[21] Appl. No.: 639,663

[22] Filed: Jan. 9, 1991

[51] Int. Cl.[5] ..... F21V 3/00

[52] U.S. Cl. ..... 362/363; 362/455; 362/800

[58] Field of Search ..... 362/189, 374, 455, 800, 362/363, 806, 457

[56] References Cited

U.S. PATENT DOCUMENTS

| | | | |
|---|---|---|---|
| 3,604,918 | 9/1971 | Cook et al. | 362/363 |
| 3,887,803 | 6/1975 | Savage, Jr. | 362/363 |
| 4,070,568 | 1/1978 | Gala | 362/455 |
| 4,398,240 | 8/1983 | Savage, Jr. | 362/311 |
| 4,471,414 | 9/1984 | Savage, Jr. | 362/455 |
| 4,941,072 | 7/1990 | Yasumoto et al. | 362/249 |
| 4,959,761 | 9/1990 | Critelli et al. | 362/226 |

FOREIGN PATENT DOCUMENTS

| | | | |
|---|---|---|---|
| 2818973 | 11/1979 | Fed. Rep. of Germany | 362/800 |
| 588047 | 6/1959 | Italy | 362/455 |

*Primary Examiner*—Stephen F. Husar
*Attorney, Agent, or Firm*—Christie, Parker & Hale

[57] ABSTRACT

An LED holder is provided with a main body with an opening and a lens cap for mounting over the opening. The lens cap has an outside wall which has a flare about its crest. The main body has an inside wall about its opening which converges toward the opening. The lens cap is held in place on the main body by forcing the flare past the inside wall to rest against a shelf which extends inwardly from the base of the inside wall. A decorative ring can be fastened to a rim which extends outward from the main body near the base of the inside wall.

13 Claims, 2 Drawing Sheets

LED HOLDER WITH LENS

FIELD OF THE INVENTION

The present invention pertains to the field of LED holders and in particular to an LED holder having a snap-in lens and decorative lens ring.

BACKGROUND OF THE INVENTION

Existing holders for light emitting diodes (LEDs) are available in a substantially cylindrical form which surrounds the LED mounted inside. The cylindrical housing has an opening at one end upon which a lens can be mounted. The lens is typically circular with a peripheral rim. The rim is placed on a mating rim at the end of the cylindrical housing. The two rims are connected together by placing a steel ring over the lens rim and bending it around to grasp the underside of the housing rim. Fastening the lens to the housing requires a special tool for bending the ring over and around the rims of the lens and housing. The ring, typically made of steel, also adds substantially to the cost of the LED holder and limits the aesthetic variations possible to achieve different visual effects. The steel ring can be painted, however, it cannot be dispensed with.

SUMMARY OF THE INVENTION

The present invention provides an LED holder compatible with existing varieties which locks a lens into place without the need for a steel ring. The lens can be mounted by hand without the use of any special tools. In order to simulate the appearance of conventional holders, a steel ring can be placed over a protruding rim on the housing. However, since the steel ring is not required to secure the lens in place, it can be installed by hand avoiding the need for special tools.

In one embodiment, the invention encompasses an LED holder with a main body for holding the LED and the lens. A peripheral inside wall on either the main body or the lens extends from a base to a crest and has a greater perimeter at the crest than at the base. A peripheral outside wall on either the main body or the lens has a crest with a perimeter greater than the inside wall crest and no greater than the inside wall base. The outside wall base has a perimeter no greater than the inside wall crest, and one or both of the walls is adapted to flex sufficiently to allow the outside wall crest to pass the inside wall crest to fasten the lens to the main body. A shelf extending from either the inside or outside wall engages the crest of the other wall, holding the outside wall within the inside wall and securing the lens in place on the main body.

In another embodiment, the invention encompasses a method for attaching a lens of an LED holder to an LED holder main body encompassing, first, placing a crest of an outside peripheral wall of either the lens or the main body of the LED holder adjacent a crest of an inside peripheral wall of the other part, the inside wall crest having a smaller perimeter than the outside wall crest. Next, the outer wall crest is pushed past the inner wall crest to abut a peripheral shelf from which the inner wall extends. The inner wall has a perimeter proximate the shelf at least as large as the outer wall crest. Finally, the remaining portion of the outer wall is pushed toward the shelf so that the inside and outside walls flex, allowing the outside wall crest to pass the inside wall crest and contact the shelf engaging the lens on the main body.

BRIEF DESCRIPTION OF THE DRAWINGS

These and other aspects of the invention will be more fully understood by referring to the following detailed description and the accompanying drawings wherein.

DETAILED DESCRIPTION

Figure 1:
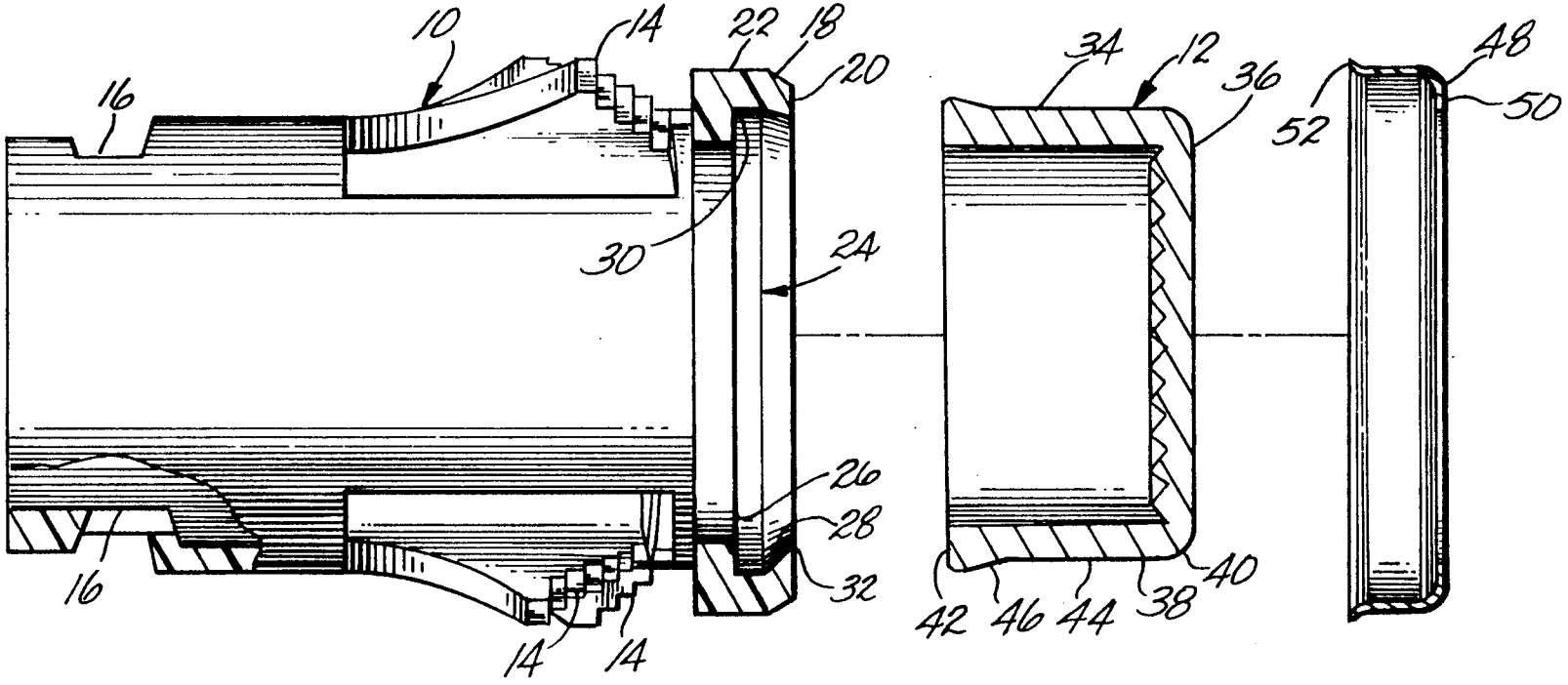
FIG. 1 is a partially cross-sectional exploded view of a lens holder constructed according to the present invention taken along line 1—1 of FIG. 3.

Referring to FIG. 1, the lens holder of the present invention has a main body 10 and a lens 12. The main body is used to support and hold an LED in place in a conventional manner as is known in the art. The main body has a set of mounting ribs 14 which can be used to connect the main body to some other device, and a pair of recesses 16 which can be used to fasten a variety of different end plugs into the end of the main body. Typically, the end plug will carry a pair of electrode tabs for electrically connecting the LED to external wiring. The main body is substantially cylindrical and holds an LED which is also substantially cylindrical. At the opposite end of the cylinder from the recesses 16 is a peripheral rim 18. The rim extends around the entire opening at the end of the cylindrical main body. The rim has a front face 20 perpendicular to the cylindrical axis, and a side face 22 parallel to the cylindrical axis. The rim is preferably annular, and its front face defines an opening 24 into the interior of the cylinder in which the LED can be housed. There is an annular shelf 26 inside the opening, extending inward around the entire opening. An inside wall 28 extends from the shelf substantially axially away from the interior of the main housing. The inside wall has a base 30 in contact with the shelf, and a crest 32 opposite the shelf. The inside wall converges as it extends away from the shelf. Preferably, the inside wall is at an angle of approximately 15° with respect to the cylindrical axis. Accordingly, the diameter of the opening at the crest 32 of the inside wall is less than the diameter of the opening at the base 30 of the wall, i.e., the wall's perimeter decreases with distance from the shelf. The shelf extends inward from the base of the wall.

A cap 12 is adapted to be inserted into the opening and rest against the shelf. The cap has a cylindrical body 34 and a circular planar end face 36. This end face constitutes the lens surface portion of the lens from which the cylindrical body 34 extends. As depicted, the lens surface has a set of concentric internal grooves 37. However, a variety of different lens treatments may be used to focus or diffuse the light emitted from the LED.

Figure 2:
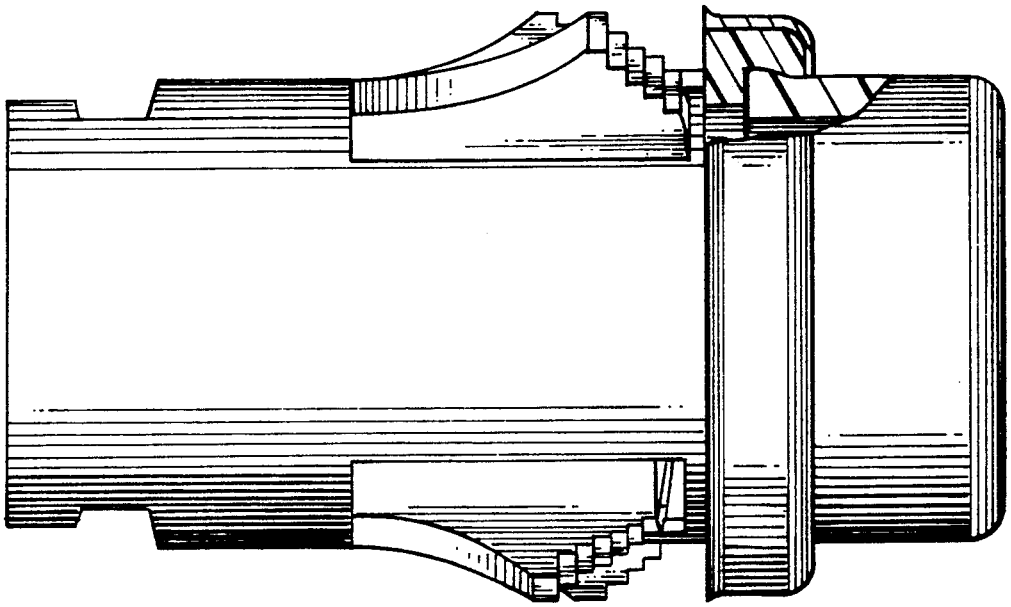
FIG. 2 is a side view, in partial cross section, of the holder of FIG. 1 assembled.
Figure 3:
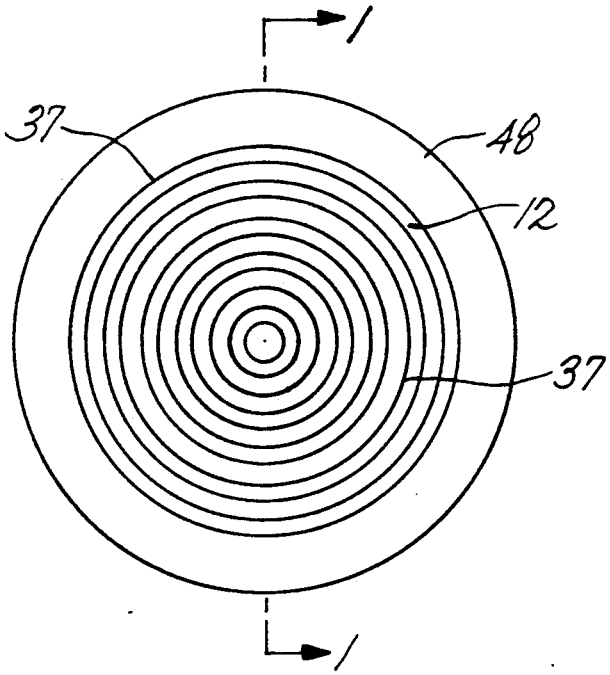
FIG. 3 is an end view of the holder of FIG. 1 assembled.

The cylindrical body has an outside wall 38 which extends from a base 40 proximate the lens surface to a crest 42 opposite the lens surface. At the end of the wall near the crest, the outside wall flares outward, i.e., the outside wall diverges around its perimeter. Preferably, from a straight section 44 which extends from the lens surface and which is parallel to the cylindrical axis of the lens, the outside wall has a flare 46 which extends at an angle of 15° with respect to the axis of the cylindrical lens. The outward flare of the lens matches the outward flare of the inside wall on the main body. The outside diameter of the outside wall at its crest is greater than the inside diameter of the inside wall at its crest. However, the diameter of the crest is preferably a small amount smaller than the inside diameter of the base of the inside wall in the main body. In this way, the flares on the end of the lens hold the lens in place on the main body against the flare on the main body's inside wall, as shown in FIG. 2.

The main body and lens are preferably made of a resilient flexible plastic which allows the lens to be installed onto the main body by hand. In use, an LED is mounted into the main body using techniques known in the art, and the lens is then snapped into place over the LED. This can be done by angling the lens so that an edge of the outside wall, i.e., a portion of the outside wall crest, contacts the shelf at one point. Since the walls are curved, the portion of the outside wall which contacts the shelf is pressed toward the shelf by applying pressure to the lens surface. Pressure is then applied progressively along the rest of the outside wall, beginning with the contacting portion and moving toward the opposite side of the lens surface, slowly pressing the remainder of the outside wall past the crest of the inside wall until the lens snaps into place. As this happens, the lens' outside wall is bent inward and the main body inside wall is bent outward until the flare on the lens passes the crest of the inside wall. After this, the inside wall is free to bend back into its normal position and the lens crest is also free to bend back to its normal position. As can be seen in the cross-sectional portion of FIG. 2, the crest of the lens is engaged between the inside wall and the shelf, holding the lens in place. The edges of the lens or of the main body can be beveled to guide the inside and outside walls to bend as the lens is inserted into the main body. The lens can be removed by pulling the lens and main body apart. Alternatively, the lens can be installed by pushing it directly onto the main body without first pressing an edge of the lens' outside wall into contact with the shelf. This, however, requires a greater amount of force and makes it difficult to align the lens over the main body.

With the LED and lens in place, and with the appropriate wiring provided, the lens holder is ready to be mounted. However, in some situations it may be desired to provide a decorative ring around the perimeter of the lens. In the present invention, a decorative ring 48 is provided as a rim cover which simulates the appearance of fastening rings found on conventional holders. The ring is adapted to slide over the rim 18 on the end of the main body. Any variety of techniques may be used to attach the ring to the main body. The ring can be constructed of a variety of materials, depending on the decorative or functional effect which is desired. It is presently preferred that the ring be constructed of a resilient material, for example, chrome-plated steel, and that its diameter decrease with distance from its outer face 50 to its inner edge 52. The inner edge is flared outward to aid in initially aligning the ring over the rim. In this way, as the ring is pressed over the constant diameter side face 22 of the main body rim, it is stretched and held in place by the resiliency of the steel over the rim 18. FIG. 2 shows how the ring covers the rim when installed. The decorative ring can also be installed by hand without the use of any special tools.

As shown in the drawings, the outside and inside walls are continuous, substantially cylindrical walls and not projecting fingers. This is preferred in order to provide the most secure mountings for the lens and in order to simplify production. However, a great variety of modifications and adaptations may be performed to the invention as described above without departing from the spirit and scope of the present invention. The parts need not be cylindrical, but may have elliptical, oblong or polygonal shapes. The inside and outside walls may be reversed so that the main body is pressed into the lens rather than vice versa. The shelf against which the inside wall crest abuts may be provided on either the lens or the main body, so the shelf may be provided either inside the perimeter of the outside wall as shown in the drawings, or it may be provided outside the perimeter of the inside wall. The shelf is provided primarily to prevent the inside wall from continuing to slide past the outside wall. In the embodiment shown in the drawings, this would result in the lens traveling further into the main body. The shelf prevents the lens from traveling further into the main body, and the inside wall prevents the lens from traveling out of the main body. By disclosing only a single embodiment, it is not intended to limit the scope of the invention to that illustrated embodiment but only by the claims below.

What is claimed is:

1. An LED holder comprising:

a main body for holding the LED, the main body having a peripheral shelf and an inside wall extending from the outside periphery of the shelf to a crest, and wall converging as it extends away from the shelf; and a lens having a lens surface and an outside wall extending from the lens surface to a crest, the outside wall diverging as it extends away from the lens surface to engage the converging inside wall when the outside wall crest is seated on the shelf, the inside and outside walls being adapted to flex sufficiently to allow the outside wall to be pushed past the inside wall crest to seat on the shelf; and wherein the main body further comprises a peripheral rim outside the inside wall, and a decorative rim cover for engaging and substantially covering the rim.

2. Holder of claim 1 wherein the main body is cylindrical, the shelf extends radially, and the inside wall perimeter decreases as it extends from the shelf.

3. Holder of claim 1 wherein the lens has a substantially circular lens surface and wherein the outside wall perimeter increases as it extends from the lens surface.

4. Holder of claim 1 wherein the inside wall converges at an angle of approximately 15° with respect to the main body's cylindrical axis.

5. Holder of claim 4 wherein the outside wall diverges at an angle of approximately 15° from a normal to the plane of the circular lens surface.

6. Holder of claim 1 wherein the holder is constructed substantially of molded plastic.

7. An LED holder comprising:

a cylindrical main body for holding an LED within its interior, having a radially extending peripheral shelf and a substantially axial inside wall extending from the shelf to a crest, the inside wall perimeter having a greater diameter at the shelf than at the crest; and a lens having a lens surface and a substantially cylindrical outer wall extending from the lens surface to a crest, the outer wall perimeter having an increasing diameter as it extends from the lens surface, the perimeter diameter of the outside wall crest being greater than the perimeter diameter of the inside wall crest but no greater than the inside wall perimeter diameter at the shelf, the inside and outside walls being adapted to flex substantially to allow the outside wall crest to be pushed past the inside wall crest to seat on the shelf and be engaged by the inside wall; and wherein the cylindrical outside wall extends parallel to the wall's cylindrical axis and then diverges from the axis proximate the outside wall's crest, the main body further comprises a peripheral rim outside the inside wall, and a decorative rim cover for engaging and substantially covering the rim.

8. Holder of claim 7 wherein the inside wall extends from the shelf at an angle approximately 15° with respect to the cylindrical axis toward the axis.

9. Holder of claim 7 wherein the outside wall extends from the lens surface at an angle approximately 15° with respect to a cylindrical axis away from that axis.

10. Holder of claim 7 wherein the lens surface is substantially circular, and the outside wall extends outward from the surface at an angle approximately 15° with respect to a normal to the plan of the circle.

11. Holder of claim 7 wherein the outside walls diverge at an angle of approximately 15° with respect to the wall's axis proximate the crest.

12. Holder of claim 7 wherein the holder is constructed substantially of molded plastic.

13. A method for attaching a lens of an LED holder to an LED holder main body comprising:

placing a substantially circular crest of an outside wall of one of either the lens or the main body adjacent a substantially circular crest of an inside wall of the other of either the lens or the main body, the diameter of the outside wall crest being greater than the diameter of the inside wall crest;

pushing an edge of the outside wall crest past the inside wall crest to abut a shelf that extends from the base of the inside wall, the diameter of the inside wall proximate the shelf being at least as large as the outside wall crest diameter;

pushing the outside wall beginning with the portion adjacent the edge that abuts the shelf and pushing at locations progressively further away from that edge toward the shelf to flex the walls and allow the outside wall to progressively pass the inside wall crest and contact the shelf, engaging the lens within the inside wall crest; and pressing a decorative ring onto a rim extending radially outwardly from the main body proximate the shelf.

* * * * *

UNITED STATES PATENT AND TRADEMARK OFFICE

CERTIFICATE OF CORRECTION

PATENT NO. : 5,126,929

DATED : June 30, 1992

INVENTOR(S) : David A. Cheselske

It is certified that error appears in the above-identified patent and that said Letters Patent is hereby corrected as shown below:

Column 1, line 12, move "available" two spaces to the left, corresponding to the margin.

Column 4, line 28, before "wall" delete "and", and insert --the--.

Column 4, line 32, after "extends" delete "away".
Column 4, line 45, change "claim 1" to -- claim 2 --.
Column 4, line 48, change "claim 1" to -- claim 2 --.

Column 5, line 15, after "angle" insert -- of --.
Column 5, line 18, after "angle" insert -- of --.
Column 5, line 23, change "plan" to -- plane --.

Signed and Sealed this

Seventh Day of September, 1993

Bruce Lehman

*Attest:*

BRUCE LEHMAN

*Attesting Officer*

*Commissioner of Patents and Trademarks*